US006972724B1

(12) United States Patent
Tian et al.

(10) Patent No.: US 6,972,724 B1
(45) Date of Patent: Dec. 6, 2005

(54) SELF-CORRECTING MOBILE ANTENNA CONTROL SYSTEM AND METHOD

(75) Inventors: Bin Tian, San Diego, CA (US); Judd Erlenbach, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 15 days.

(21) Appl. No.: 10/864,944

(22) Filed: Jun. 9, 2004

(51) Int. Cl.[7] ..... H01Q 1/32
(52) U.S. Cl. ..... 343/711; 343/757; 343/766; 342/354; 342/359
(58) Field of Search ..... 343/711, 757, 760, 343/765, 766; 342/354, 359, 422

(56) References Cited

U.S. PATENT DOCUMENTS 5,621,415 A * 4/1997 Tuck ..... 342/354
6,271,798 B1 * 8/2001 Endo et al. ..... 343/713
6,389,340 B1 * 5/2002 Rayner ..... 701/35
6,774,860 B2 * 8/2004 Downs ..... 343/765
2003/0141990 A1 * 7/2003 Coon ..... 340/902

* cited by examiner

*Primary Examiner*—Tan Ho
(74) *Attorney, Agent, or Firm*—Phil Wadsworth; Charles D. Brown; Richard A. Bachand

(57) ABSTRACT

A self-correcting mobile antenna control system and method. A method is provided for controlling the direction of an antenna mounted on a vehicle. The method includes determining a position decision based on a direction change signal output from a direction sensor, determining an energy decision based on a signal strength indicator, combining the position decision and the energy decision to produce an antenna control signal, and adjusting the antenna's direction based on the antenna control signal. The system also operates to periodically calibrate itself to offset any sensor errors so that intensive calibration procedures can be avoided.

28 Claims, 6 Drawing Sheets

SELF-CORRECTING MOBILE ANTENNA CONTROL SYSTEM AND METHOD

BACKGROUND

I. Field

The present invention relates generally to antenna control systems, and more particularly, to system and methods for providing a self-correcting mobile antenna control system.

II. Description of the Related Art

Advances in technology have provided for increased automation in many industries. For example, in the shipping industry, technology has allowed for the shipment and delivery of cargo virtually around the clock. Delivery vehicles now carry and deliver cargo to all parts of the country. For example, in the trucking industry, cargo-carrying tractor-trailers may be driven hundreds or thousands of miles to reach a delivery site. In some cases, the delivery vehicles may make one or more intermediate stops before reaching their final destinations.

Technology improvements in communication systems have greatly impacted how vehicles are designed and used. For example, it is now possible for all types of vehicles to receive signals broadcast from land-based and/or satellite transmitters. Typically, these signals provide geographic information so that it is possible to precisely determine a vehicle's position. For example, global positioning systems (GPS) transmit position signals from satellites, and automobiles using simple antenna systems can receive these signals.

However, it has become increasingly desirable to provide certain vehicles with high-gain directional antenna systems. For example, in the trucking industry, it would be very beneficial to be able to transmit vehicle parameters and other information from in-route trucks to a remote central station. This type of communication can be accomplished using land-based or satellite transceivers. Although transmitting electronics to perform this function are generally available, a specialized antenna system is required to establish a reliable and efficient communication channel between a moving vehicle, such as a truck, and a land-based or satellite transceiver. For example, the communication channel may require that a directional antenna be mounted on the vehicle and controlled so that it always points towards a communication satellite. The directional antenna will allow more information to be sent to and from the vehicle and reduce interference to other satellites.

Unfortunately, conventional systems that operate to keep a directional antenna on a moving platform accurately pointed have several problems. First, these systems typically use expensive components, for example, one or more gyroscopes (yaw-rate sensors). Because these components can be expensive, outfitting an entire fleet of trucks with such a system may become cost prohibitive. Additionally, these components are not well suited to the harsh environment encountered by trucks as they travel to all parts of the country in all weather conditions. Furthermore, because even the most expensive components tend to drift and produce errors over time, conventional systems generally require intensive calibration procedures and expensive maintenance.

Therefore, what is needed is an antenna control system for use in a moving vehicle to accurately point a directional antenna mounted on the vehicle toward a desired location to allow a communication channel with a land-based or satellite transceiver to be established and maintained. The system should be simple, accurate, low cost, and not require extensive calibration or maintenance, thereby allowing installation on a large number of vehicles without excessive costs.

SUMMARY

In one or more embodiments, a system comprising methods and apparatus is provided for use in a vehicle to provide an inexpensive and accurate self-correcting antenna control system. The system is especially well suited for use with moving vehicles where it is necessary to keep an on-board directional antenna accurately pointed toward a desired land-based or satellite transceiver.

In one embodiment, the system utilizes an inexpensive yaw-rate sensor to determine how to move the vehicle's antenna so that it remains pointed toward the selected transceiver's position. Because the inexpensive sensor is not perfectly calibrated and may produce errors over time, the system operates to provide an additional compensation signal to correct for any sensor error that may occur. The system derives the compensation signal from measurements of signal energy provided by the antenna. As a result, the control system uses the signal energy measurements as feedback in combination with the sensor's output signal to generate a control signal that is used to keep the antenna accurately pointed.

Additionally, a calibration signal is derived from the compensation signal to continuously calibrate the sensor. Because the system operates to continuously calibrate itself, it is possible for the system to utilize an inexpensive yaw rate sensor. As a result, it is possible to avoid the costs and intensive calibration procedures associated with larger and more expensive conventional systems.

In one embodiment, a method is provided for controlling the direction of an antenna mounted on a vehicle. The method comprises determining a position decision based on a direction change signal output from a direction sensor, determining an energy decision based on a signal strength indicator, combining the position decision and the energy decision to produce an antenna control signal, and adjusting the antenna's direction based on the antenna control signal.

In another embodiment, apparatus is provided for controlling the direction of an antenna mounted on a vehicle. The apparatus comprises position tracking logic that operates to determine a position decision based on a direction change signal output from a position sensor, and signal tracking logic that operates to determine an energy decision based on a signal strength indicator. The apparatus also comprises combining logic that operates to combine the position decision and the energy decision to produce an antenna control signal, and a motor that operates to control the antenna's direction based on the antenna control signal.

In still another embodiment, apparatus is provided for controlling the direction of an antenna mounted on a vehicle. The apparatus comprises means for determining a position decision based on a direction change signal output from a direction sensor, and means for determining an energy decision based on a signal strength indicator. The apparatus also comprises means for combining the position decision and the energy decision to produce an antenna control signal, and means for adjusting the antenna's direction based on the antenna control signal.

In still another embodiment, a computer-readable media is provided that comprises instructions, which when executed by a processor in an antenna control system, operate to control the direction of an antenna mounted on a vehicle. The computer-readable media comprises instructions for determining a position decision based on a direction change signal output from a direction sensor, and instructions for determining an energy decision based on a signal strength indicator. The computer-readable media also comprises instructions for combining the position decision and the energy decision to produce an antenna control signal, and instructions for adjusting the antenna's direction based on the antenna control signal.

BRIEF DESCRIPTION OF THE DRAWINGS

The foregoing aspects and the attendant advantages of the embodiments described herein will become more readily apparent by reference to the following detailed description when taken in conjunction with the accompanying drawings wherein.

DETAILED DESCRIPTION

The following detailed description describes an antenna control system that includes methods and apparatus for controlling an antenna on a vehicle. For example, in one embodiment, the vehicle includes a directional antenna that allows the vehicle to communicate with a land-based or satellite-based transceiver. In order to establish a reliable communication channel and reduce interference to other satellites, the antenna needs to be accurately pointed toward the location of the remote transceiver as the vehicle moves.

In one embodiment, the control system comprises an inexpensive yaw-rate sensor (gyro) that outputs a direction change signal. The control system uses this direction change signal to generate a control signal that controls a motor used to point the antenna. The control system further comprises hardware and/or software to process signals received at the antenna, which are combined as part of the control signal to control the direction of the antenna. Additionally, the control system generates a correction signal that is used to periodically adjust for any sensor errors. Thus, the system provides accurate control of the direction of the vehicle's antenna, even while the vehicle is in motion, to maintain a reliable communication channel with the remote transceiver. The system also operates to periodically calibrate itself to offset any sensor errors so that intensive calibration procedures can be avoided.

It should also be understood that the described control system could be used to control the direction of an antenna mounted on virtually any type of vehicle, including but not limited to, trucks, buses, automobiles, construction equipment, and watercraft.

Figure 1:
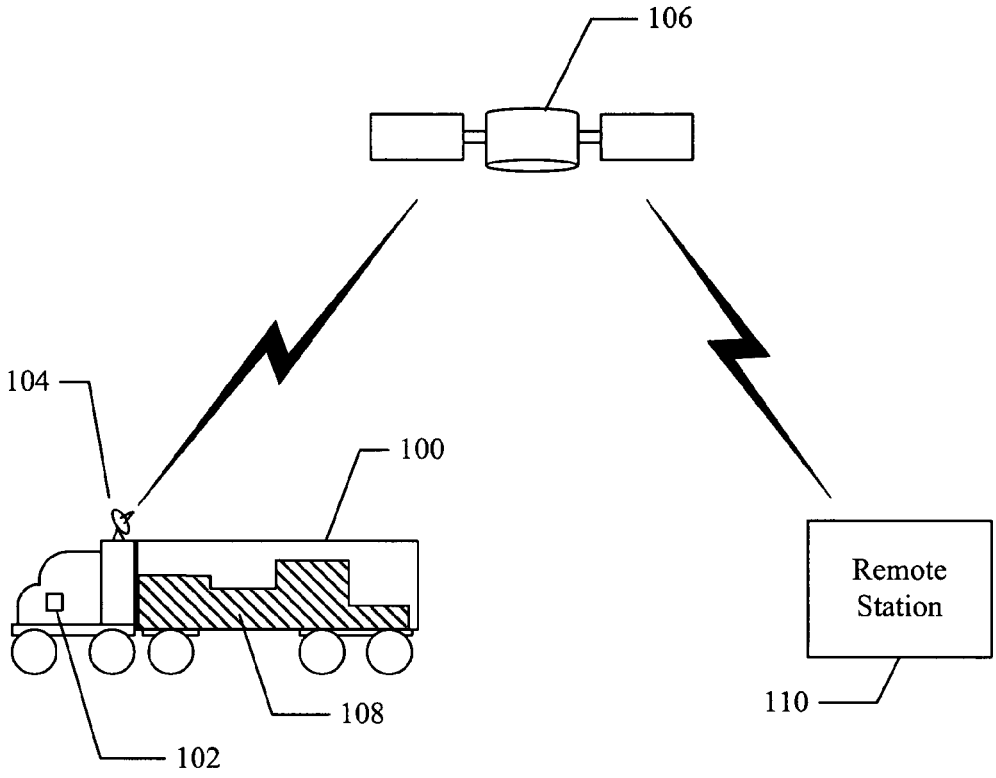
FIG. 1 shows a vehicle that includes one embodiment of an antenna control system.

FIG. 1 shows a vehicle 100 that includes one embodiment of an antenna control system 102 for controlling the direction of an antenna 104 mounted on the vehicle 100. The vehicle 100 in this example comprises a tractor-trailer, commonly used in the long-haul trucking industry to transport goods from shippers to consignees. The vehicle 100 further comprises a mobile communication terminal ("MCT", not shown) for communicating with one or more remote stations 110 using the antenna 104 to communicate via a satellite-based wireless communication system that uses satellite 106. Generally, the MCT resides onboard a tractor portion of the vehicle 100 so as to be easily accessible by the vehicle operator. The trailer portion of the vehicle 100 typically includes cargo 108 to be delivery to one or more delivery sites.

The communication system provides two-way communication between the vehicle 100 and a remote station 110. The communication system may also provide communication between the vehicle 100 and third parties, such as a fleet management center or dispatch center, family members, governmental authorities, consignees, shippers, and so on. The vehicle 100 may also comprise other wireless systems that could be used in addition or in the alternative to the satellite system, such as an analog or a digital cellular telephone system, an RF communication system, or a wireless data communication network, such as a cellular digital packet data (CDPD) network. Such other wireless systems may also comprise one or more antennas that may be controlled by one or more embodiments of the antenna control system.

In one embodiment, the control system 102 operates to detect the orientation of the vehicle and generate a control signal that is used to control the direction of the antenna 104 so that it remains pointed in the direction of a land-based or satellite transceiver and/or antenna. In one embodiment, the system 102 comprises an inexpensive yaw-rate sensor that outputs a direction change signal as the vehicle moves. The direction change signal is processed and combined with a compensation signal to create the control signal that is used to control the antenna 104. The compensation signal is derived from the signal strength of the radio signals received by the antenna. A correction signal is also generated that periodically calibrates the system so that any errors produced by the yaw-rate sensor may be periodically corrected while the vehicle is in-route without the need for intensive calibration procedures.

As a result, the antenna control system 102 operates to control the direction of the antenna 104 while the vehicle is in motion to allow the vehicle's communication system to establish and maintain a wireless communication channel to communicate with the remote station 110 via the satellite 106.

Figure 2:
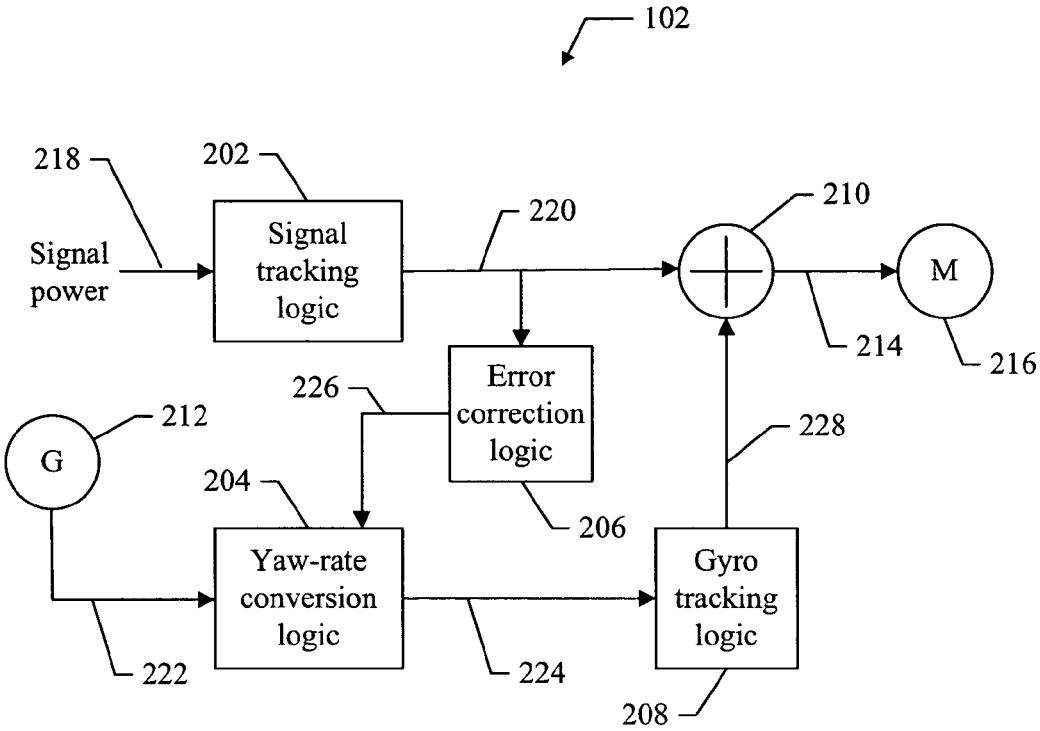
FIG. 2 shows a detailed diagram of one embodiment of an antenna control system for use in a vehicle.

FIG. 2 shows a detailed diagram of one embodiment of the antenna control system 102 shown in FIG. 1. The control system 102 comprises signal tracking logic 202, yaw-rate conversion logic 204, error correction logic 206, gyro tracking logic 208, and summing logic 210. The control system 102 receives a direction change signal 222 from a yaw-rate sensor (gyro) 212 and outputs a control signal 214 to a motor 216 used to steer a directional antenna. For example, the system 102 may be used to steer the antenna 104 shown in FIG. 1.

It should be understood that the elements of the control system 102 shown in FIG. 2 represent just one embodiment, and that implementation of the control system 102 could be achieved in one of any number of ways using greater or fewer functional elements. For example, some or all of the function elements shown could be implemented hardware, or in a computer program executed by one or more processors.

The signal tracking logic 202 may comprise a processor, CPU, gate array, logic, discrete circuitry, software, or any combination of hardware and software. The signal tracking logic 202 includes input logic to receive a signal power indicator 218 that indicates an amount of signal power received by the directional antenna. For example, if the antenna is pointed to receive signals broadcast from a satellite, the receiving circuitry (not shown) connected to the antenna determines the amount of signal power received and outputs the signal power indicator 218 to the control system 102.

The signal tracking logic 202 processes the received signal power indicator 218 and outputs an energy-tracking decision signal 220 that is input to the summing logic 210. The energy-tracking decision signal 220 indicates whether the antenna should be moved in order to optimize the received signal power. The energy-tracking decision signal 220 is also input to the error correction logic 206.

The yaw-rate conversion logic 204 may comprise a processor, CPU, gate array, logic, discrete circuitry, software, or any combination of hardware and software. The conversion logic 204 receives the direction change signal 222 from the yaw-rate sensor 212. The conversion logic 204 converts the direction change signal 222 to an angle using a conversion function to form an angle signal 224 that is input to the gyro tracking logic 208. In one embodiment, the conversion logic 204 provides a positive or negative adjustment to the direction change signal 222 when converting the direction change signal 222 to the angle signal 224.

The conversion logic 204 also receives an error correction signal 226 from the error correction logic 206. The error correction signal 226 is used as a calibration signal to calibrate the operation of the yaw-rate conversion logic 204. For example, in one embodiment, the yaw-rate conversion logic 204 applies one or more conversion factors to the direction change signal 222 to produce the angle signal 224. The error correction signal 226 is used by the yaw-rate conversion logic 204 to adjust the conversion factors, and thereby fine-tune the conversion of the direction change signal 222 to compensate for any sensor errors that may occur.

The gyro tracking logic 208 may comprise a processor, CPU, gate array, logic, discrete circuitry, software, or any combination of hardware and software. The gyro tracking logic 208 operates to receive the angle signal 224 and produce a gyro decision signal 228 that is input to the summing logic 210. The gyro tracking logic 208 comprises any suitable hardware and/or software to produce the gyro decision signal 228. For example, in one embodiment, the gyro tracking logic 208 comprises a look up table that is used to translate the angle signal 224 to the gyro decision signal 228. In another embodiment, the gyro tracking logic 208 comprises a processor that performs one or more calculations to produce the gyro decision signal 228 from the angle signal 224.

The summing logic 210 may comprise a processor, CPU, gate array, logic, discrete circuitry, software, or any combination of hardware and software. The summing logic 210 operates to combine the energy decision signal 220 and the gyro decision signal 228 to produce the control signal 214 that is input to the motor 216 to control the direction of the antenna. The motor 216 comprises any suitable hardware and/or software to convert the control signal 214 into any signal or information needed to actuate the motor 216 to adjust the direction of the antenna to achieve optimum tracking as the vehicle moves.

During operation of the control system 102, the yaw-rate sensor 212 outputs the direction change signal 222 that is used by the gyro tracking logic 208 to generate the gyro decision signal 228. The decision signal 228 is the primary signal used to control the direction of the vehicle's antenna via the motor 216. The energy tracking decision signal 220 generated by the signal tracking logic 202 is used to fine-tune the control signal 214 to achieve the optimum antenna direction.

The sensor 212 may be any type of direction sensor, however, because the sensor 212 may be an inexpensive yaw-rate sensor, it may be prone to errors over time. The error correction logic 206, in combination with the conversion logic 204, operate to calibrate for sensor 212 errors by processing the error correction signal 226, which is derived from the energy tracking decision 220. Thus, the system operates to continually adjust the antenna's direction as the vehicle moves to maintain accurate tracking of a remote transceiver, thereby allowing a reliable communication channel to be established and maintained. Furthermore, the error correction logic 206 in combination with the conversion logic 204 operate to periodically calibrate the conversion of the direction change signal 222, so that the system can maintain its accuracy while the vehicle is in-route without requiring costly and intensive calibration procedures.

Figure 3:
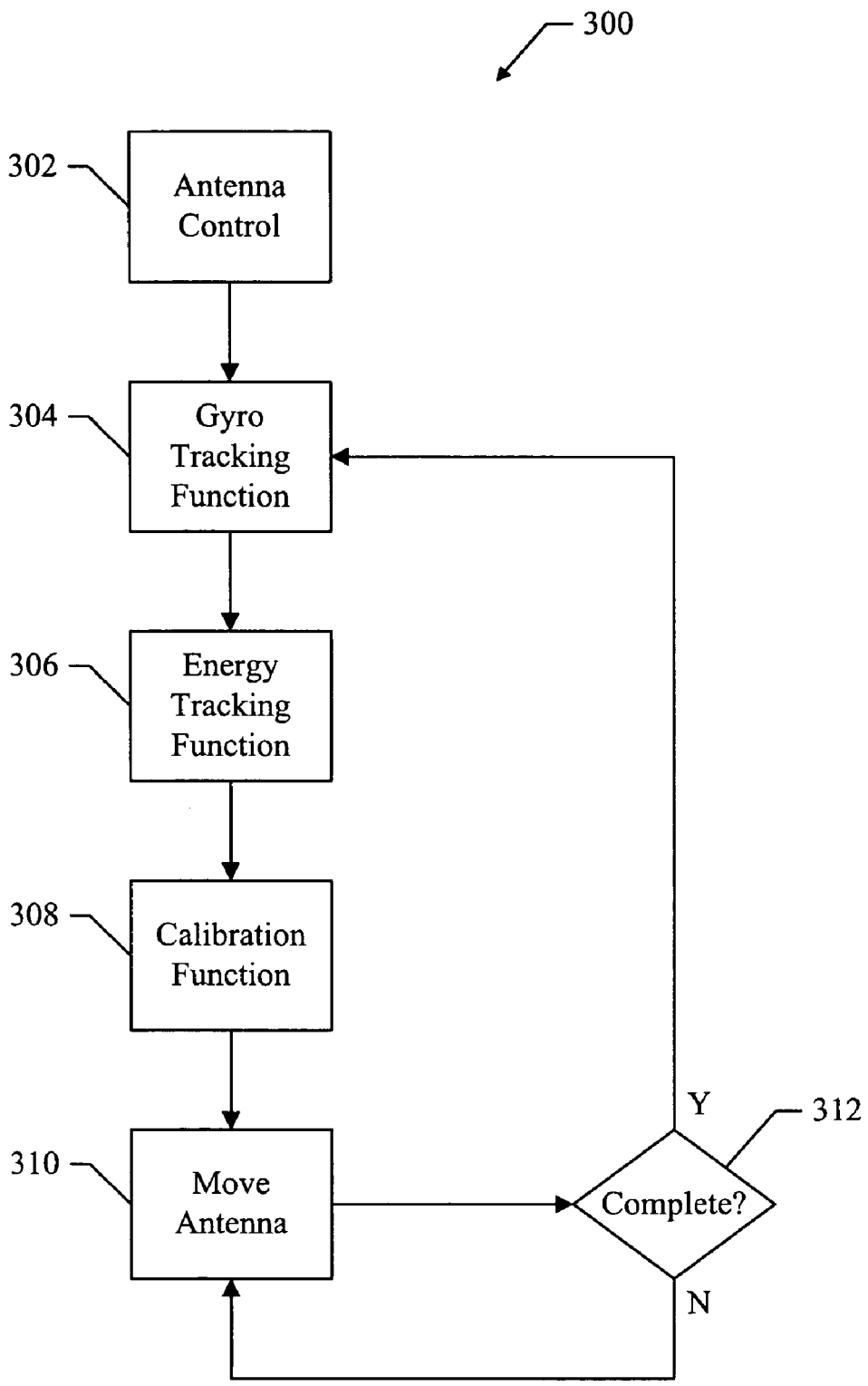
FIG. 3 shows one embodiment of a method for operating the antenna control system of FIG. 2 to control an antenna on a vehicle.

FIG. 3 shows one embodiment of a method 300 for operating one embodiment of an antenna control system, for example, the antenna control system 102 in FIG. 2. In one embodiment, the method 300 operates to continually adjust the direction of antenna on a moving vehicle. In one embodiment, periodic intervals (referred to as slot intervals) are used to determine when one or more functions of the method 300 are performed. For example, direction change information may be obtained from a yaw-rate sensor during every slot interval and processed by the control system.

The method begins at block 302 where system parameters are obtained and/or initialized. For example, initial signal strength measurements of a received signal are obtained from a vehicle-mounted antenna.

At block 304, a gyro tracking function is performed. The gyro tracking function determines whether or not the direction of the antenna should be adjusted based on the movement of the vehicle as determined from an on-board yaw-rate sensor. For example, the sensor 212 outputs a direction change signal 222 that is converted to an angle which is used by the gyro tracking function to determine whether or not the antenna should be moved to point in a new direction to account for vehicle motion. In one embodiment, the gyro tracking function is performed by the yaw-rate conversion logic 204 and the gyro tracking logic 208.

At block 306, an energy tracking function is performed. The energy tracking function determines whether or not the direction of the antenna should be adjusted based on the signal energy received at the antenna. For example, the signal power indicator 218 is used by the energy tracking function to determine whether or not to move the direction of the antenna to achieve optimum signal strength. In one embodiment, the signal tracking logic 202 performs the energy tracking function.

At block 308, a calibration function is performed that adjusts the conversion of the direction change signal 222 to the angle signal 224. The calibration function makes use of information from the energy tracking function 306 to determine whether or not the conversion of the direction change signal 222 needs calibration. For example, the direction change signal 222 may include errors that may be attributed to sensor drift. For example, in one embodiment, the calibration function adjusts conversion factors used to convert the direction change signal 222 to the angle signal 224. Thus, the calibration function operates to compensate for any sensor errors that may occur over time. In one embodiment, the error correction logic 206 and the gyro conversion logic 204 operate to perform the calibration function.

At block 310, an antenna adjustment function is performed that changes the direction of the antenna by controlling a motor. In one embodiment, the outputs from the gyro tracking function and the energy tracking function are combined to derive a control signal that is used to control a motor that changes the direction of the antenna. For example, in one embodiment, the summing logic 210 combines the outputs of the two functions to produce the control signal 214 that used to control the motor 216 to adjust the direction of the antenna.

At block 312, a test is performed to determine if any adjustment to the direction of the antenna is completed. Before additional outputs from the gyro tracking function and energy tracking function are computed, it is preferable that the antenna be completely stopped at its new position. Once it is determined that the antenna has stopped at its new position, the method 300 proceeds to block 304 where it is determined whether or not the antenna requires additional re-positioning.

It should be noted that the method 300 describes the operation of one embodiment of an antenna control system for use on a moving vehicle, and that changes, additions, deletions, or rearrange of the method is within the scope of the described embodiments.

Figure 4:
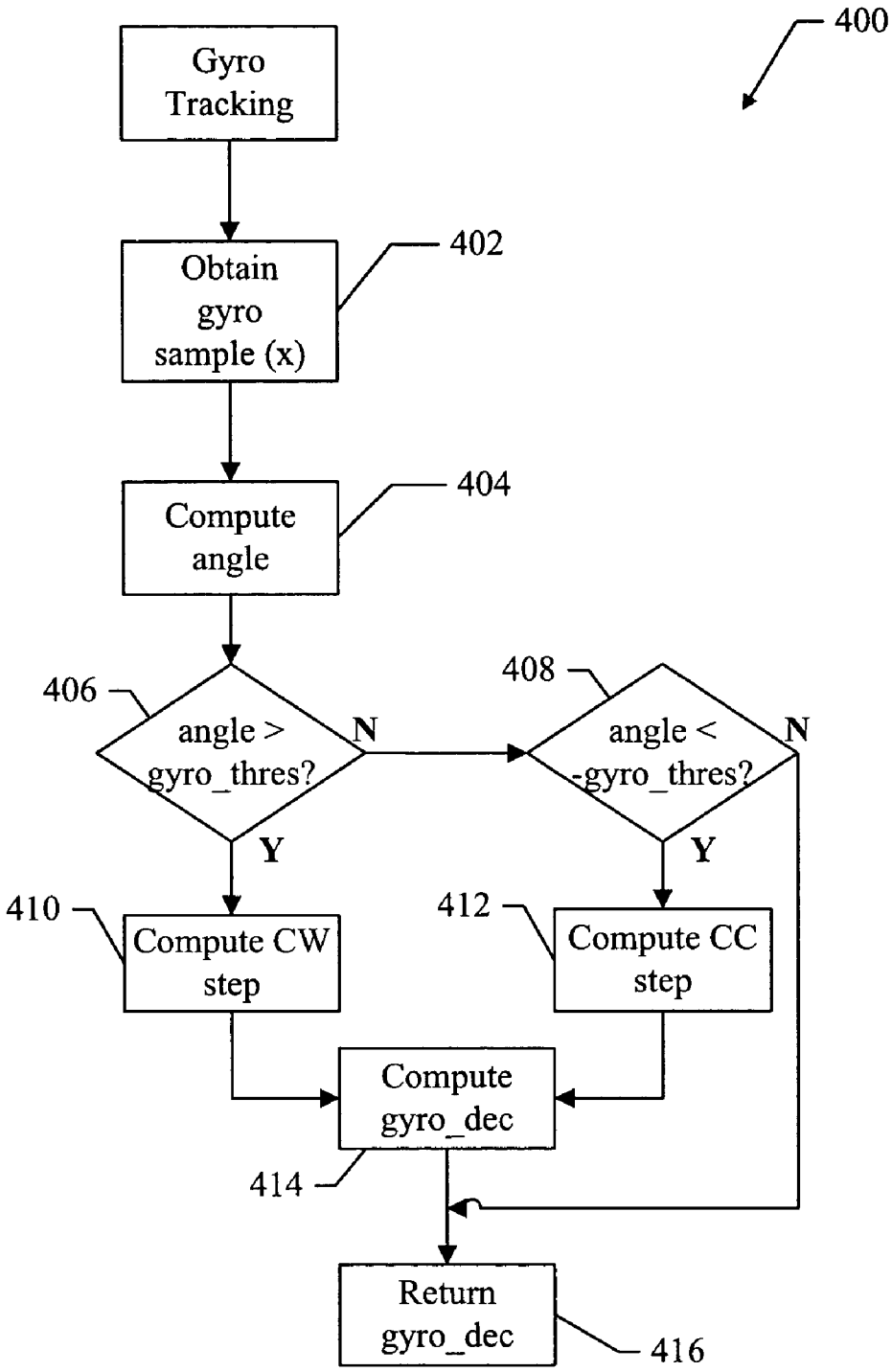
FIG. 4 shows one embodiment of a method for operating the antenna control system of FIG. 2 for determining a position decision.

FIG. 4 shows a detailed diagram of one embodiment of a method 400 for performing the gyro tracking function 304 shown in FIG. 3. It will be assumed that a yaw-rate sensor is mounted on a vehicle and that a direction change signal output from the sensor indicates a direction change of the vehicle.

At block 402, the method begins by obtaining a raw gyro sample (x) from the vehicle-mounted yaw-rate sensor. The yaw-rate sensor outputs an analog voltage that is proportional to the yaw rate of change ($d\theta/dt$) of the direction of the vehicle. The analog voltage is sampled at each slot time interval, which in one embodiment, corresponds to a 600-hertz rate.

At block 404, during each slot interval the raw gyro sample (x) is converted to an angular turn rate and accumulated (integrated) to get an estimate of the current antenna pointing error angle due to the vehicle movement. For example, the angular rate and resulting angle can be determined from the following:

$$\text{rate}=Mx+B;$$

$$\text{angle}=\text{angle}+\text{rate};$$

$$acc_raw_rate=acc_raw_rate+x$$

where stored parameters M (scale factor) and B (bias factor) determine the linear equations that converts the raw sample to the angular turn rate. Since the actual bias and scale factor may be different from component to component and can vary over time due to environmental changes and/or aging process, the values of M and B are constantly calibrated in a self-correction process as discussed later. The variable acc_raw_rate, which stores the accumulated raw sample values since the last update of M and B, is used for this calibration process. Note that the accumulations of angle and acc_raw_rate are performed after each slot interval, even during the antenna movement.

At block 406, when the antenna is not being moving, a test is performed to compare the accumulated antenna pointing error angle with a threshold angle (gyro_thres), which in one embodiment is approximately 0.67–0.75 times the size of one adjustment step (gyro_step). If the angle is greater than the threshold angle, the method proceeds to block 410. If the angle is not greater than the threshold angle, then the method proceeds to block 408.

At block 408, a test is performed to compare the converted angle against a negative version of the threshold angle. If the angle is greater than the negative version of the threshold angle, there is no need to move the antenna so the gyro decision (gyro_dec) is set to zero and the method proceeds to block 416. If the angle is less than the negative version of the threshold angle, then the method proceeds to block 412.

At block 410, a step number is computed that represents the number of adjustment steps needed to move the antenna clockwise an amount equivalent to the angle. Since the adjustment step size (gyro_step) of the gyro tracking is fixed and only an integer number of steps can be made, the number of degrees the antenna will be turned may not equal the actual accumulated angle. In one embodiment, the adjustment step size (gyro_step) is 0.9 degrees, the same as the motor step size and the computation is performed as follows, where an antenna direction value (ant_dir) is set to 1 to indicate clockwise motion.

$$stepNum=\text{round}(\text{angle}/gyro_step)$$

$$ant_dir=1$$

At block 412, a computation of step number is made in a way that is similar to the computation made at step 410. However, this computation is based on the fact that the antenna needs to move in a counter-clockwise direction and is computed as follows, where an antenna direction value (ant_dir) is set to −1 to indicate counterclockwise motion.

$$stepNum=\text{round}(-\text{angle}/gyro_step)$$

$$ant_dir=-1$$

At block 414, a gyro decision (gyro_dec) is computed by multiplying the step number computed at block 410 or 412 by the motor step value and the antenna direction indicator. The gyro decision indicates the direction and the number of degrees the antenna should be moved. The accumulated error angle is adjusted by subtracting the number of degrees the antenna may be turned based on the computed gyro decision. The above computations can be expressed as follows.

$$gyro_dec=stepNum*gyro_step*ant_dir$$

$$\text{angle}=\text{angle}-gyro_dec$$

At block 416, the gyro decision value (gyro_dec) is returned to the main operational method, (i.e., the method 300). The gyro decision value is the number of degrees the antenna is to be turned, where a positive value indicates a clockwise turn and negative value indicates a counterclockwise turn. However, commanding the antenna to move occurs at a later stage in the process. The gyro tracking function is very effective at correcting short-term antenna pointing errors due to vehicle movement. However, since it is an open-loop tracking function, over the long-term, tracking errors may gradually built up, but these errors will be corrected by the energy based tracking function as described below.

It should be noted that the method 400 describes one embodiment of a gyro tracking function for use in an antenna control system, and that changes, additions, deletions, or rearrange of the method is within the scope of the described embodiments.

Figure 5:
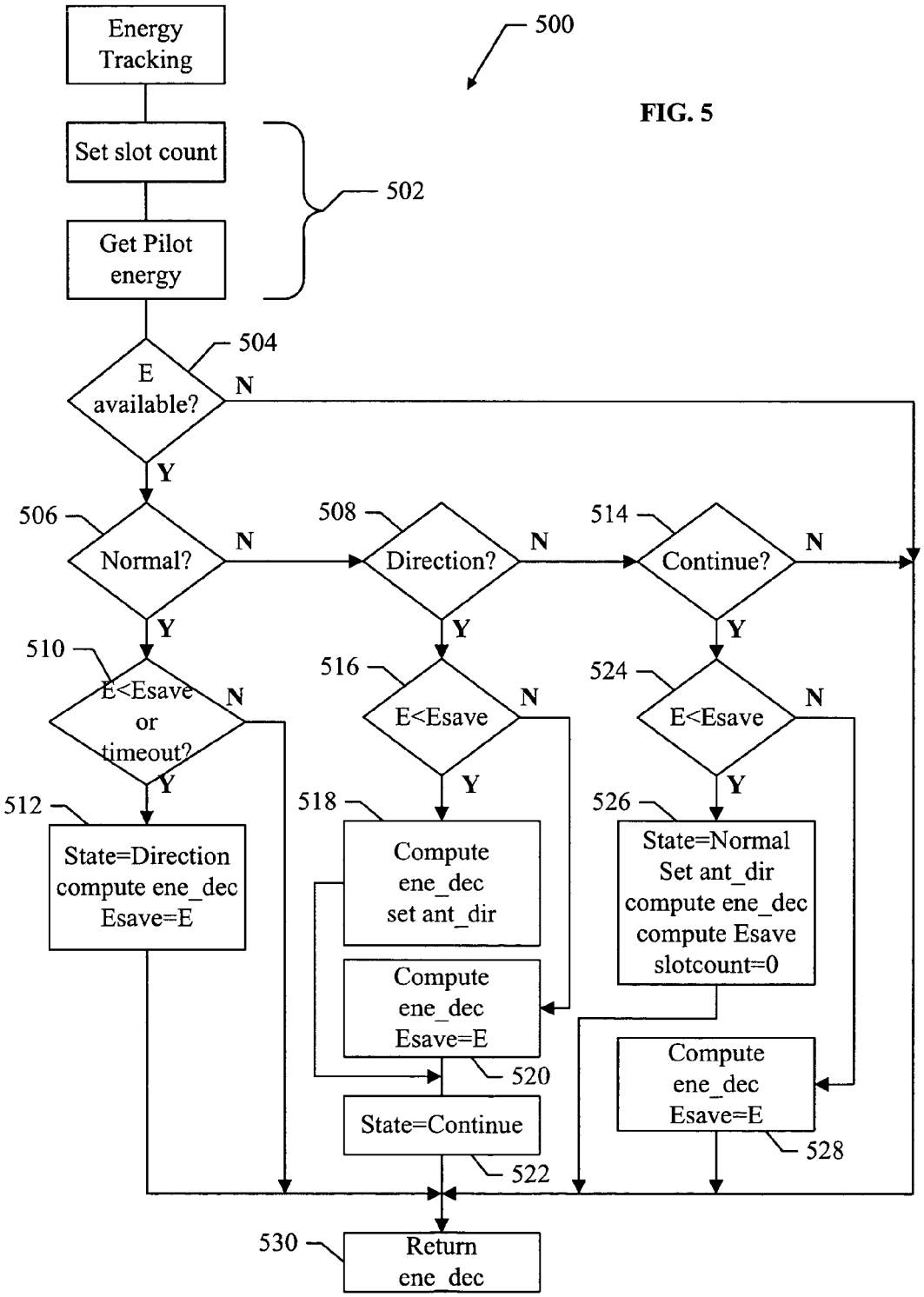
FIG. 5 shows one embodiment of a method for operating the antenna control system of FIG. 2 for determining an energy decision.

FIG. 5 shows one embodiment of a method 500 for providing the energy tracking function 306. The energy tracking function uses the received signal strength measurement at the antenna to determine whether or not the direction of the antenna needs to be changed. The goal of the energy tracking function is to keep the signal energy received at the antenna as strong as possible.

At block 502, parameters are initialized. For example, in one embodiment, a slot count value (slot_count) is updated to reflect how long the energy tracking function has not tested the neighboring antenna directions, and the data samples that are used for the measurement of the received signal strength at the antenna are collected. For example, in one embodiment, the received strength of the signal 218 of FIG. 2 is derived from a Pilot signal received at the antenna. The Pilot signal is used by the communication system to setup and maintain a reliable communication channel.

At block 504, a test is performed to determine whether or not a new signal energy (E) measurement is available. For example, in one embodiment, the signal energy measurement E is computed from non-coherently accumulated Forward link Pilot burst samples collected at block 502 over a fixed number of slots. However, slots in which the antenna is actually moving or when a signal is not being tracked by the receiving system are not included in the integration. For example, in one embodiment, the accumulation interval is typically 64 slots, which corresponds to about 107 milliseconds, but can be adjusted if necessary. If the accumulation is not complete, no new energy measurement is available and the method proceeds to block 530, where the function returns with an energy decision (ene_dec) that indicates that no antenna move be made based on the received signal energy. When the energy accumulation is complete, energy is available and the method proceeds to perform an algorithm that processes the energy in accordance with one of three states.

At block 506, a test is performed to determine if the method should enter a state referred to as the "Normal" state. In one embodiment, the beginning state value is set during the initialization performed at 502. If the state value is not "Normal", the method proceeds to block 508. If the state value is "Normal", the method proceeds to block 510.

At block 510, a test is performed to compare the energy E to a saved energy value (Esave), which has been set to be slightly below (typically 0.5 dB) the energy that was received when the antenna was last "peaked" by the energy tracking routine. For example, the energy tracking routine attempts to move the antenna to obtain a peak energy value. It will be assumed that in a prior operation of the routine, the antenna was positioned to obtain a peak energy value and that this value was used to derive the saved energy value (Esave).

If the current energy value is greater than the saved energy value (Esave), and if a slot counter (slot_count) indicates a time interval less than a timeout value, the method proceeds to block 530 and the energy decision will request no antenna movement. For example, the following equations are used to perform the test at block 510.

$$E<Esave, \text{ or}$$

$$slot_count>\text{timeout}$$

If the energy value is less than the saved energy value (Esave) or the slot counter has exceeded the timeout value, the method proceeds to block 512.

At block 512, the state value is changed to a "Direction" value either because the energy dropped below the threshold, or because the slot count timer exceeded its threshold value (typically two seconds, or 1200 slots). A decision to move the antenna is made in a positive (clockwise) or negative (counterclockwise) direction indicated by an antenna direction (ant_dir) value with an angle of size ant_step (0.9 degrees). It should be noted that in this embodiment, the ant_step value is equivalent to the motor step size, and the ant_dir value is "1" for clockwise motion or "−1" for counterclockwise motion. The energy value E is saved as Esave for use in processing at a later time. Thus, the following functions are performed.

$$\text{state}=\text{"Direction"}$$

$$ene_dec=ant_dir*ant_step$$

$$Esave=E$$

The method then proceeds to block 530 with an energy decision (ene_dec) value that indicates how much and in which direction the antenna is to be moved. This value is then returned to the main control method (i.e. the method 300).

The next time the method 500 is performed and energy is available at block 504, the test at block 506 fails so the method proceeds to block 508. At block 508, a test is performed to determine if the method should enter the "Direction" state. If this test fails, the method proceeds to block 514. If this test passes, the Direction state is entered and the method proceeds to block 516.

At block 516, a test is performed to compare the current energy (E) to the saved energy that was measured during the Normal state, as follows.

$$E<Esave$$

If the energy is less, the antenna was most likely moved in the wrong direction and the method proceeds to block 518. If the current energy is greater than the saved value, it is assumed the antenna was previously moved in the correct direction and the method proceeds to block 520.

At block 518, because the energy is reduced as a result of the previous antenna move, the antenna direction (ant_dir) is reversed and the energy decision is set to move the antenna two steps in the reverse direction; one to put back where it was, and another step to move it to the presumably correct direction. However, the new energy measurement is not saved. For example, the following functions are performed.

$$ant_dir=-1*ant_dir$$

$$ene_dec=2*ant_dir*ant_step$$

The method then proceeds to block 522.

At block 520, because the energy is increased as a result of the previous antenna move, the antenna decision is set to provide one step that in the same direction. In this case the new energy is saved as follows.

$$ene_dec=ant_dir*ant_step$$

$$Esave=E$$

The method then proceeds to block 522, where the state value is set to "Continue." The method then proceeds to block 530 where the energy decision is returned.

The next time the method 500 is performed and energy is available at block 504, the tests at blocks 506 and 508 fail, so the method proceeds to block 514. At block 514, a test is performed to determine if the method should enter the "Continue" state. If this test fails, the method proceeds to block 530. If this test passes, the Continue state is entered and the method proceeds to block 524.

The Continue state is used to continuously move the antenna in the same direction until the energy decreases. The antenna is then moved back one step. This process assumes that the energy level will increase as the antenna is move closer to the direction of the transmitting satellite. When the energy level decreases, it is assumed the antenna was moved too far. In other words it was moved such that its peak gain position was passed, so the antenna is moved back one step.

At block 524, a test is performed to compare the energy level with the saved energy value as follows.

$$E<Esave$$

If the energy is not less than the saved energy value, the method proceeds to block 528. If the energy is less than the saved energy value, the method proceeds to block 526.

At block 526, because the received signal energy has decreased as a result of the last antenna move, the search for the energy peak is considered over and the state value is changed to "Normal." Additionally, the energy decision is set to move the antenna one step back and the slot count is reset. The computations are performed as follows.

$$\text{State}=\text{Normal}$$

$$ant_dir=-1*ant_dir$$

$$ene_dec=ant_dir*ant_step$$

$$Esave=ratio*Esave$$

$$slot_count=0$$

where, in one embodiment, ratio is set to approximately 0.89 (0.5 dB). If subsequent energy values drop by 0.5 dB, the antenna peak search routine will start again.

At block 528, the energy decision value is set to move the antenna another step in the same direction and the energy is saved as the saved energy value (Esave) as follows.

$$ene_dec=ant_dir*ant_step$$

$$Esave=E$$

At block 530, the energy tracking function returns the energy decision to the main control method.

It should be noted that the method 500 describes one embodiment of an energy tracking function for use in an antenna control system, and that changes, additions, deletions, or rearrange of the method is within the scope of the described embodiments.

Figure 6:
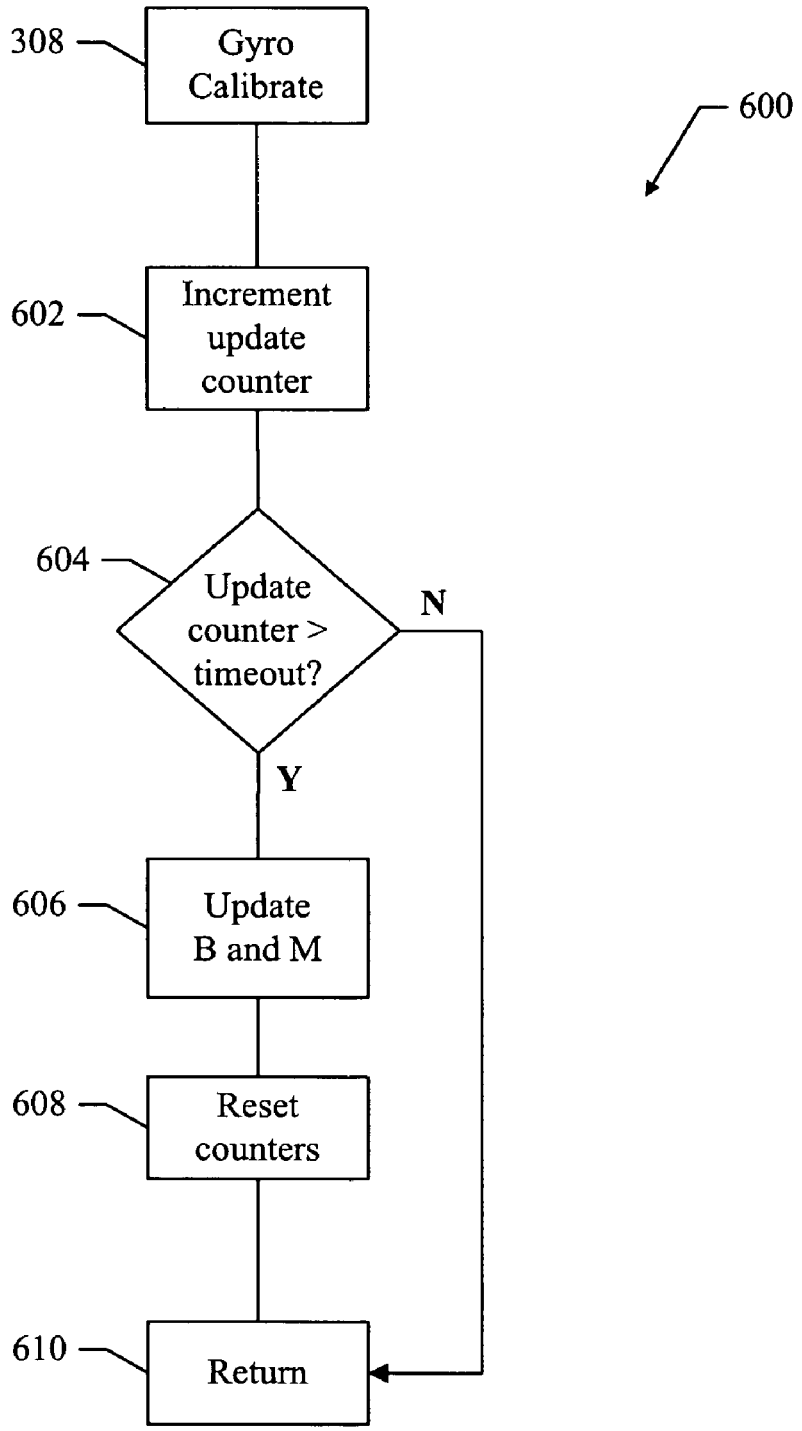
FIG. 6 shows one embodiment of a method for operating the antenna control system of FIG. 2 to provide a calibration function.

FIG. 6 shows one embodiment of a calibration method 600 for providing the calibration function 308. After the gyro tracking 400 and energy tracking 500 methods are performed, the calibration method 600 operates to calibrate or adjust parameters that are used to convert the output of the yaw-rate sensor to an angle. As described above, the gyro tracking method 400 obtains a raw gyro sample (x) that is converted to an angular rate of change ($d\theta/dt$). Variable rate parameters M (scale factor) and B (bias factor) described the linear equation that converts the raw sample to the angular rate of change. The calibration method 600 updates these two parameters based on the value of the energy decision (ene_dec) returned from the energy tracking method 500.

At block 602, the energy tracking decision, which is considered as the equivalent of gyro tracking error, is accumulated into acc_track_err. An update counter (upd_counter), which tells the time elapsed since last calibration, is updated. In one embodiment, the two parameters are set as follows.

$$acc_track_err=acc_track_err+ene_dec$$

$$upd_counter=upd_counter+1$$

At block 604, a test is performed to determine whether the update counter (upd_counter) indicates that a timeout value has been exceeded. In one embodiment, the timeout value is equivalent to 600 slots, or approximately one second. If the upd_counter does not exceed its timeout value, then the method proceeds to block 610. If the upd_counter exceeds it timeout value, then the method proceeds to block 606.

At block 606, the parameters M and B are updated using a Least Mean Square (LMS) method that is based on the accumulated tracking error returned from the energy tracking routine as follows.

$$B=B-acc_track_err*B_learning_factor$$

$$M=M+acc_track_err*acc_raw_rate*M_learning_factor$$

Parameters M_learning_factor and B_learning_factor control the rate at which M and B are adjusted using the LMS method. In one embodiment, the value for the B_learning_factor is 0.1, which corresponds to a time constant of approximately 10 times the update counter (upd_counter) timeout value (approximately 10 seconds). The value of M_learning_factor is chosen to be 1.85 e−7 to ensure the stability of the learning process.

At block 608, after an update all the counters are then reset to accumulate again as follows.

$$acc_track_err=0$$

$$acc_raw_rate=0$$

$$upd_counter=0$$

At block 610, the calibration method 600 returns to the main method.

The basic premise of the calibration method 600 is that once the antenna is correctly peaked, if the gyro is perfectly calibrated, the energy routine would never have to re-peak the antenna. In this case and energy decision will be zero and accumulated tracking error (acc_track_err) will remain zero. Consequently, parameters B and M will remain constant. The larger the parameters are in error, the larger and more frequently will the energy tracking routine have to re-peak the antenna. In this case, the energy decision will be non-zero more frequently and the accumulated error will grow. As a result, the parameters M and B are driven to new values.

As provided at block 310 of the method 300, the last step provided by the antenna control system combines the decisions coming from the gyro 400 and energy 500 tracking methods. Because the gyro method 400 can make a decision essentially every slot and the fastest the energy method 500 can make a decision is at the rate that energy is accumulated, the combined antenna move decision is usually based only on the result of the gyro tracking method 400. The gyro and energy methods return their respective decisions in quantized angular measurements. The antenna can be moved in steps of 0.9 degrees with a positive step signifying a clockwise adjustment and a negative step signifying a counterclockwise step.

When the antenna is commanded to move, it takes a finite amount of time to do so. During the slot(s) when the antenna is moving, both gyro tracking and energy tracking functions do not make new decisions, although all the accumulations and counters are still updated as described above.

A self-correcting antenna control system has been described that operates to control an antenna on a moving vehicle. Accordingly, while one or more embodiments of the antenna control system have been illustrated and described herein, it will be appreciated that various changes can be made to the embodiments without departing from their spirit or essential characteristics. Therefore, the disclosures and descriptions herein are intended to be illustrative, but not limiting, of the scope of the invention, which is set forth in the following claims.

We claim:

1. A method for controlling the direction of an antenna mounted on a vehicle, the method comprising:

determining a position decision based on a direction change signal output from a direction sensor;

determining an energy decision based on a signal strength indicator;

combining the position decision and the energy decision to produce an antenna control signal; and adjusting the antenna's direction based on the antenna control signal.

2. The method of claim 1, wherein the step of determining the position decision comprises:

computing an angle from the direction change signal; and comparing the angle to a threshold value to determine the position decision.

3. The method of claim 2, wherein the direction sensor is a yaw-rate sensor and the step of computing the angle comprises computing the angle from the direction change signal output from the yaw-rate sensor based on a bias factor (B) and a scale factor (M).

4. The method of claim 3, further comprising adjusting the bias factor (B) and the scale factor (M) based on the energy decision.

5. The method of claim 1, wherein the step of determining the energy decision comprises;

deriving the signal strength indicator from a radio signal received at the antenna; and comparing the signal strength indicator to a saved energy value to determine the energy decision.

6. The method of claim 1, further comprising repeating the steps of claim 1 at selectable periodic intervals.

7. The method of claim 6, further comprising determining the position decision more frequently than determining the energy decision.

8. Apparatus for controlling the direction of an antenna mounted on a vehicle, the apparatus comprising:

position tracking logic that operates to determine a position decision based on a direction change signal output from a direction sensor;

signal tracking logic that operates to determine an energy decision based on a signal strength indicator;

combining logic that operates to combine the position decision and the energy decision to produce an antenna control signal; and a motor that operates to control the antenna's direction based on the antenna control signal.

9. The apparatus of claim 8, wherein the position tracking logic comprises:

logic to compute an angle from the direction change signal; and logic to compare the angle to a threshold value to determine the position decision.

10. The apparatus of claim 8, wherein the direction sensor is a yaw-rate sensor and the logic to compute the angle comprises logic to compute the angle from the direction change signal output from the yaw-rate sensor based on a bias factor (B) and a scale factor (M).

11. The apparatus of claim 10, further comprising logic to adjust the bias factor (B) and the scale factor (M) based on the energy decision.

12. The apparatus of claim 8, wherein the signal tracking logic comprises;

logic to derive the signal strength indicator from a radio signal received at the antenna; and logic to compare the signal strength indicator to a saved energy value to determine the energy decision.

13. The apparatus of claim 8, further comprising logic to produce the antenna control signal at selectable periodic intervals.

14. The apparatus of claim 13, further comprising logic to determine the position decision more frequently than determining the energy decision.

15. Apparatus for controlling the direction of an antenna mounted on a vehicle, the apparatus comprising:

means for determining a position decision based on a direction change signal output from a direction sensor;

means for determining an energy decision based on a signal strength indicator;

means for combining the position decision and the energy decision to produce an antenna control signal; and means for adjusting the antenna's direction based on the antenna control signal.

16. The apparatus of claim 15, wherein the means for determining the position decision comprises:

means for computing an angle from the direction change signal; and means for comparing the angle to a threshold value to determine the position decision.

17. The apparatus of claim 16, wherein the direction sensor is a yaw-rate sensor and the means for computing the angle comprises means for computing the angle from the direction change signal output from the yaw-rate sensor based on a bias factor (B) and a scale factor (M).

18. The apparatus of claim 16, further comprising means for adjusting the bias factor (B) and the scale factor (M) based on the energy decision.

19. The apparatus of claim 15, wherein the means for determining the energy decision comprises;

means for deriving the signal strength indicator from a radio signal received at the antenna; and means for comparing the signal strength indicator to a saved energy value to determine the energy decision.

20. The apparatus of claim 15, further comprising means for determining the antenna control signal at selectable periodic intervals.

21. The apparatus of claim 20, further comprising means for determining the position decision more frequently than determining the energy decision.

22. A computer-readable media comprising instructions, which when executed by a processor in an antenna control system, operate to control the direction of an antenna mounted on a vehicle, the computer-readable media comprising:

instructions for determining a position decision based on a direction change signal output from a direction sensor;

instructions for determining an energy decision based on a signal strength indicator;

instructions for combining the position decision and the energy decision to produce an antenna control signal; and instructions for adjusting the antenna's direction based on the antenna control signal.

23. The computer-readable media of claim 22, wherein the instructions for determining the position decision comprises:

instructions for computing an angle from the direction change signal; and instructions for comparing the angle to a threshold value to determine the position decision.

24. The computer-readable media of claim 22, wherein the direction sensor is a yaw-rate sensor and the computer-readable media further comprises instructions for computing the angle from the direction change signal output from the yaw-rate sensor based on a bias factor (B) and a scale factor (M).

25. The computer-readable media of claim 23, further comprising instructions for adjusting the bias factor (B) and the scale factor (M) based on the energy decision.

26. The computer-readable media of claim 22, wherein the instructions for determining the energy decision comprise;

instructions for deriving the signal strength indicator from a radio signal received at the antenna; and instructions for comparing the signal strength indicator to a saved energy value to determine the energy decision.

27. The computer-readable media of claim 22, further comprising instructions for determining the antenna control signal at selectable periodic intervals.

28. The computer-readable of claim 27, further comprising instructions for determining the position decision more frequently than determining the energy decision.

* * * * *